US008267276B2

(12) United States Patent
Francomano

(10) Patent No.: US 8,267,276 B2
(45) Date of Patent: Sep. 18, 2012

(54) CAP FOR HOLDING POWDER TO MIXED WITH A FLUID IN A BOTTLE

(76) Inventor: Joel Francomano, Dallas, TX (US)

( * ) Notice: Subject to any disclaimer, the term of this patent is extended or adjusted under 35 U.S.C. 154(b) by 1024 days.

(21) Appl. No.: 12/286,171

(22) Filed: Sep. 29, 2008

(65) Prior Publication Data

US 2009/0321380 A1 Dec. 31, 2009

Related U.S. Application Data

(60) Provisional application No. 61/133,177, filed on Jun. 26, 2008.

(51) Int. Cl.

| | |
|---|---|
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 41/56*** | (2006.01) |
| ***B65D 1/24*** | (2006.01) |
| ***B65D 25/04*** | (2006.01) |
| ***B65D 57/00*** | (2006.01) |
| ***B65D 85/00*** | (2006.01) |
| ***B65D 51/18*** | (2006.01) |
| ***B65D 25/08*** | (2006.01) |
| ***B65D 1/36*** | (2006.01) |
| ***B67D 3/00*** | (2006.01) |
| ***B67D 7/06*** | (2010.01) |
| ***A47G 19/00*** | (2006.01) |

(52) U.S. Cl. ..... 220/521; 220/212; 220/253; 222/142.9; 222/519; 222/520; 215/227; 215/228; 215/DIG. 8; 206/219

(58) Field of Classification Search ..... 215/227, 215/228, DIG. 8; 220/212, 253, 521; 222/142.9, 222/519, 520; 206/219
See application file for complete search history.

(56) References Cited

U.S. PATENT DOCUMENTS

| | | | | |
|---|---|---|---|---|
| 4,120,432 | A * | 10/1978 | Fuchs | 222/565 |
| 4,544,063 | A * | 10/1985 | Neward | 206/540 |
| 5,123,574 | A * | 6/1992 | Poulos | 222/362 |
| 5,419,445 | A * | 5/1995 | Kaesemeyer | 215/11.1 |
| 6,926,138 | B1 * | 8/2005 | Basham et al. | 206/222 |
| 6,945,393 | B2 * | 9/2005 | Cho | 206/219 |

* cited by examiner

*Primary Examiner* — Anthony Stashick
*Assistant Examiner* — Andrew T Kirsch
(74) *Attorney, Agent, or Firm* — Dale B Halling

(57) ABSTRACT

A cap for holding a powder to be mixed with a fluid in a bottle has a product cap with a reservoir. The product cap has a top wall and a side wall. The product cap has a number of inner protrusions on the side wall and a number of outer protrusions on the side wall. A cylindrical safety gate has a number of grooves. The inner protrusions of the product cap mate with the grooves of the safety gate. The cylindrical safety gate has a gate and an aperture at an end of the cylindrical safety gate. A bottle cap with a cylindrical body has a threaded end and a gate end. The gate end has a number of grooves that mate with the outer protrusions. The bottle cap has a gate and an aperture between the threaded end and the gate end.

15 Claims, 6 Drawing Sheets

CAP FOR HOLDING POWDER TO MIXED WITH A FLUID IN A BOTTLE

RELATED APPLICATIONS

The present invention claims priority on provisional patent application, Ser. No. 61/133,177, filed on Jun. 26, 2008, entitled "Pop Top" and is hereby incorporated by reference.

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

It has become more common for people to buy bottled water for home or when they are on the run. A number of drink mix manufactures, such as Kool Aid®, Gatorade®, Crystal light®, are making single serving packets. However, it is difficult to pour the ingredients from these packets into water bottles. A number of solutions to this dilemma have been tried including caps that hold the mix and then a membrane is punctured to release the mix into the water. A couple of problems have occurred with this solution. One problem is part of the membrane falls off into the water. Another problem is the membrane fails to break and release the contents. Another solution that has been tried is a cap that has an extension into the bottle with an orifice on the side of the cap. A problem with this solution is that some of the mix get stuck inside the cap. A second problem with this solution is that the extension takes up some of the volume of the bottle. Other solutions require modifications to existing water bottle designs, are difficult or expensive to manufacture.

Thus there exists a need to a single mix solution that does not have a membrane, does not require modification to existing water bottle designs and is inexpensive to manufacture.

BRIEF SUMMARY OF INVENTION

A cap for holding a powder to be mixed with a fluid in a bottle that overcomes these and other problems has a product cap with a reservoir. The product cap has a top wall and a side wall. The product cap has a number of inner protrusions on the side wall and a number of outer protrusions on the side wall. A cylindrical safety gate has a number of grooves. The inner protrusions of the product cap mate with the grooves of the safety gate. The cylindrical safety gate has a gate and an aperture at an end of the cylindrical safety gate. A bottle cap with a cylindrical body has a threaded end and a gate end. The gate end has a number of grooves that mate with the outer protrusions. The bottle cap has a gate and an aperture between the threaded end and the gate end, whereby pressing on the product cap causes the apertures to be aligned and the powder is released into the bottle.

DETAILED DESCRIPTION OF THE INVENTION

A cap for holding a powder to be mixed with a fluid in a bottle has a product cap with a reservoir. The product cap has a top wall and a side wall. The product cap has a number of inner protrusions on the side wall and a number of outer protrusions on the side wall. A cylindrical safety gate has a number of grooves. The inner protrusions of the product cap mate with the grooves of the safety gate. The cylindrical safety gate has a gate and an aperture at an end of the cylindrical safety gate. A bottle cap with a cylindrical body has a threaded end and a gate end. The gate end has a number of grooves that mate with the outer protrusions. The bottle cap has a gate and an aperture between the threaded end and the gate end, whereby pressing on the product cap causes the apertures to be aligned and the powder is released into the bottle. Note as used herein the term "product cap" and "bottle cap" are the items described herein and should not be interpreted to mean a generic "product cap" or generic "bottle cap."

Figure 1:
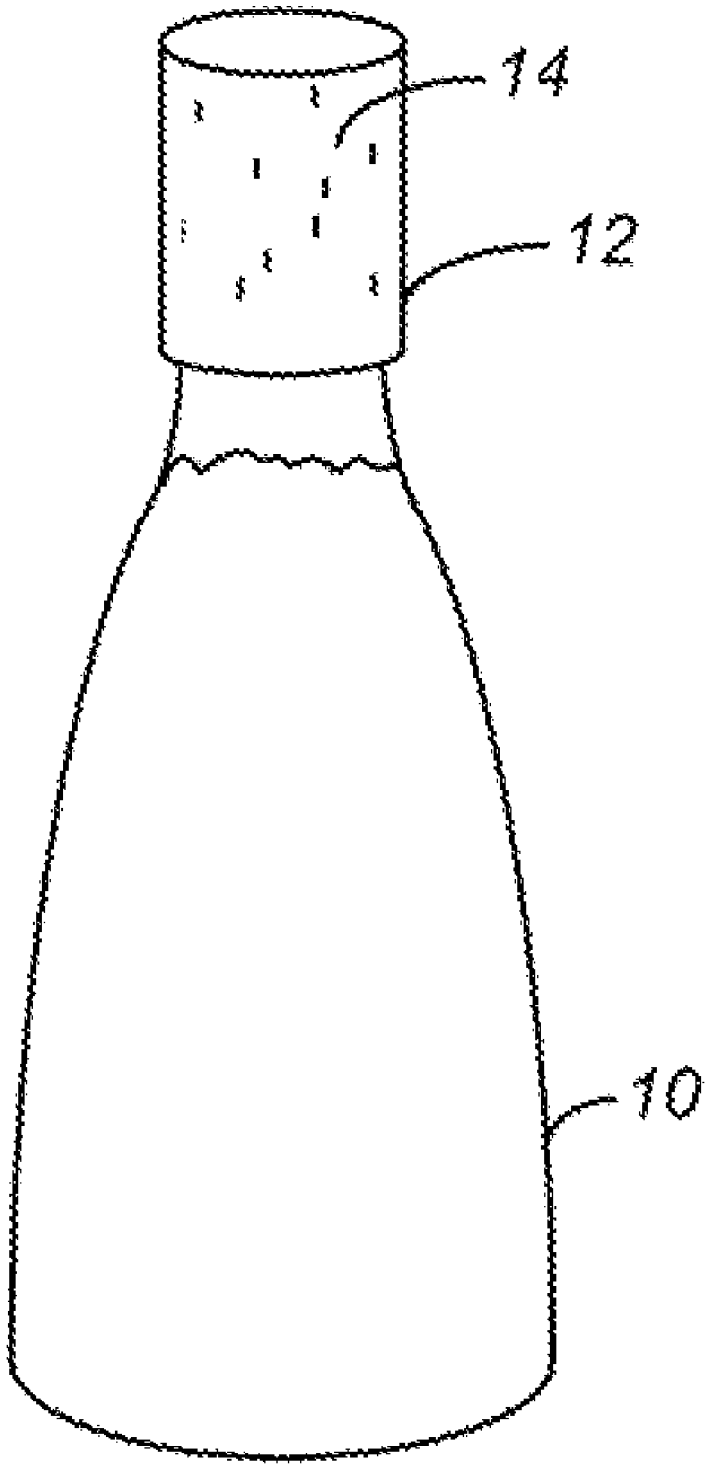
FIG. 1 is a side view of bottle with a cap in accordance with one embodiment of the invention.

FIG. 1 is a side view of bottle 10 with a cap 12 in accordance with one embodiment of the invention. The cap 12 holds a mix 14, such as a drink mix designed for a single serving. When the top portion of the cap 12 is pushed down the mix is released into the water (fluid) 16. The user then shakes the bottle 10 to thoroughly flavor the water and opens the bottle to drink the flavored water.

Figure 2:
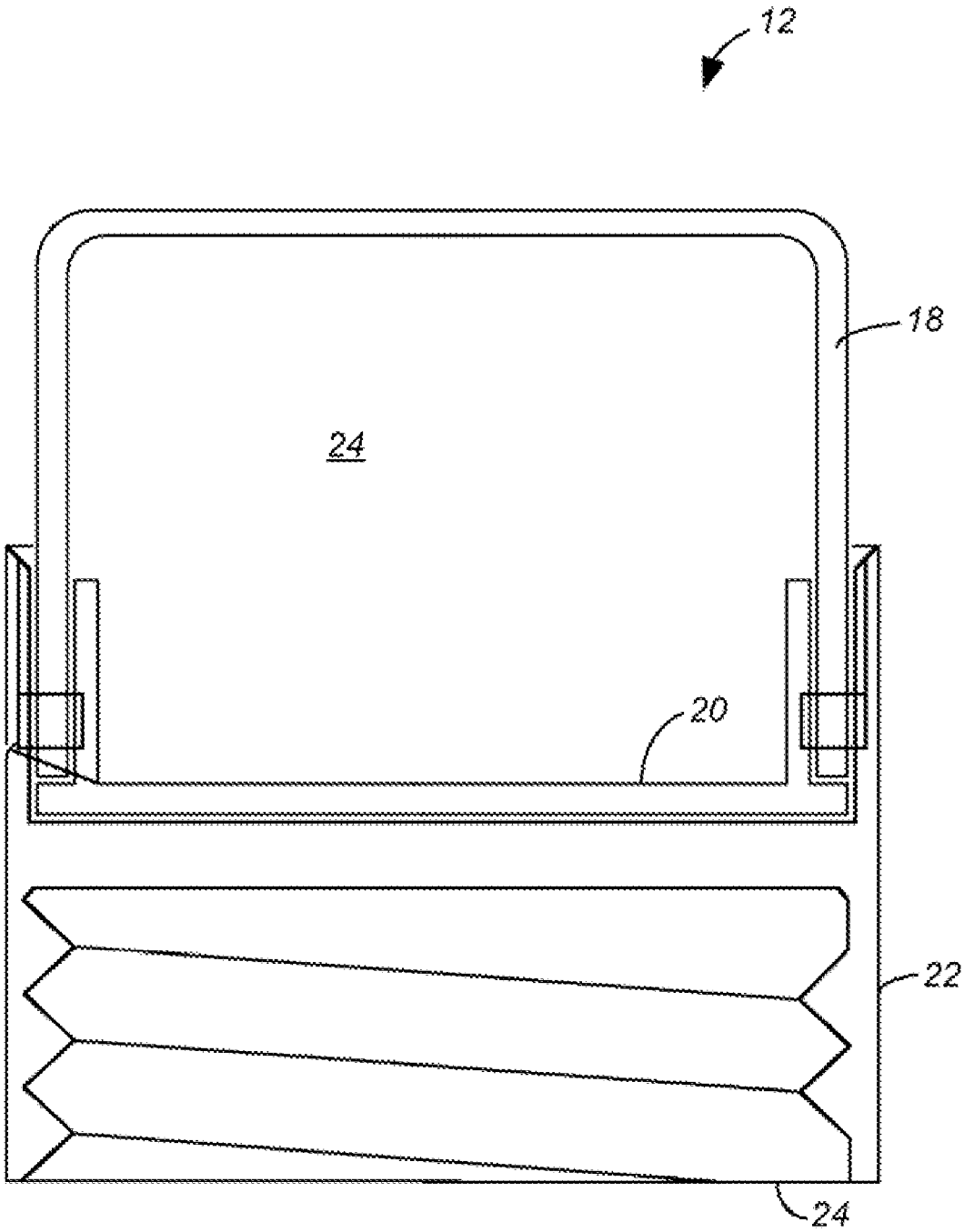
FIG. 2 is a cross sectional view of the cap in accordance with one embodiment of the invention.

FIG. 2 is a cross sectional view of the cap 12 in accordance with one embodiment of the invention. The cap 12 is made of three distinct portions: a product cap 18, a safety gate 20 and bottle cap 22. The product cap 18 has a reservoir 24 for holding a drink mix. In one embodiment, the product cap 18 is formed in two pieces that are sealed together. This makes it easier to load the product cap 18 with the flavored mix. The safety gate 20 fits inside the product cap 18, which fits inside the bottle cap 22. The bottle cap 22 has a threaded end 24 that screws onto the top of a standard water bottle, such as an individual serving water bottle that is not meant to be refilled by the consumer.

Figure 3A:
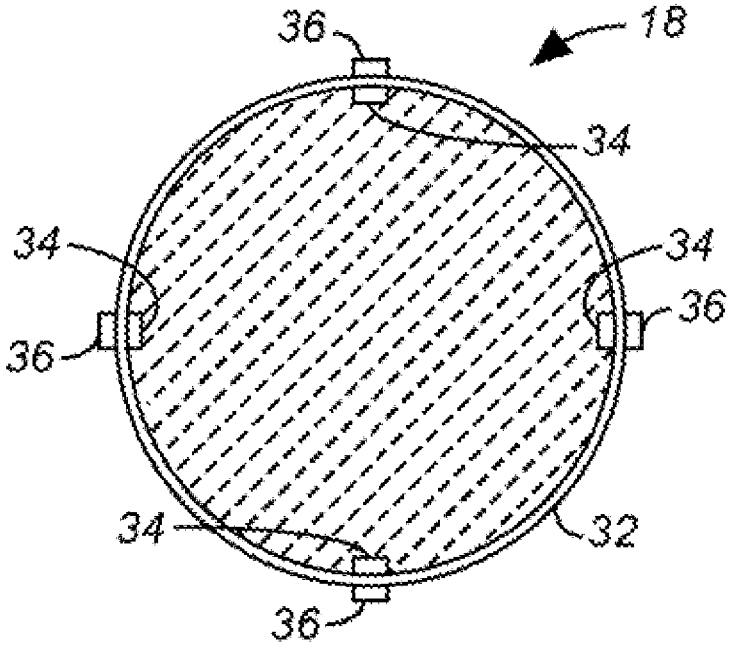
FIG. 3*a* is a bottom view of the product cap in accordance with one embodiment of the invention.
Figure 3B:
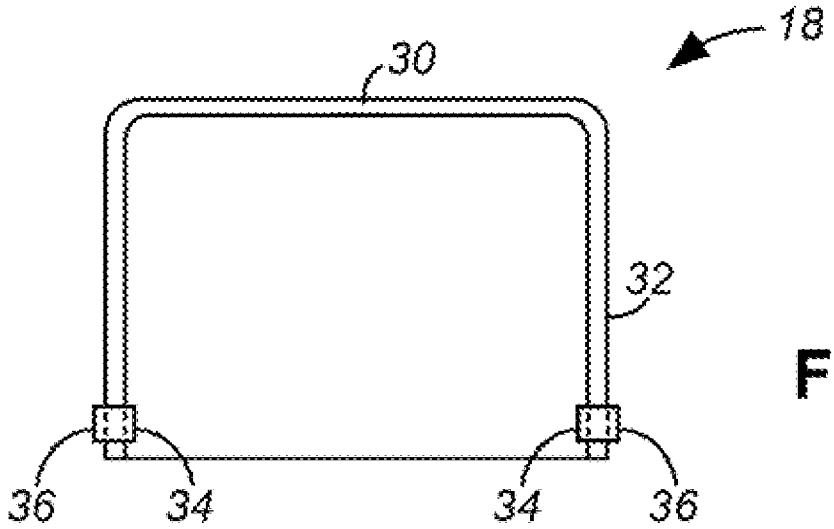
FIG. 3*b* is a cross sectional view of the product cap in accordance with one embodiment of the invention.

FIG. 3*a* is a bottom view of the product cap 18 in accordance with one embodiment of the invention. FIG. 3*b* is a cross sectional view of the product cap 18 in accordance with one embodiment of the invention. The product cap 18 has a cylindrical cup shape with a top wall 30 and a side wall 32.

The product cap 18 has a number of inner protrusions or pegs 34 and a number of outer protrusions 36 attached to the side wall 32.

Figure 4A:
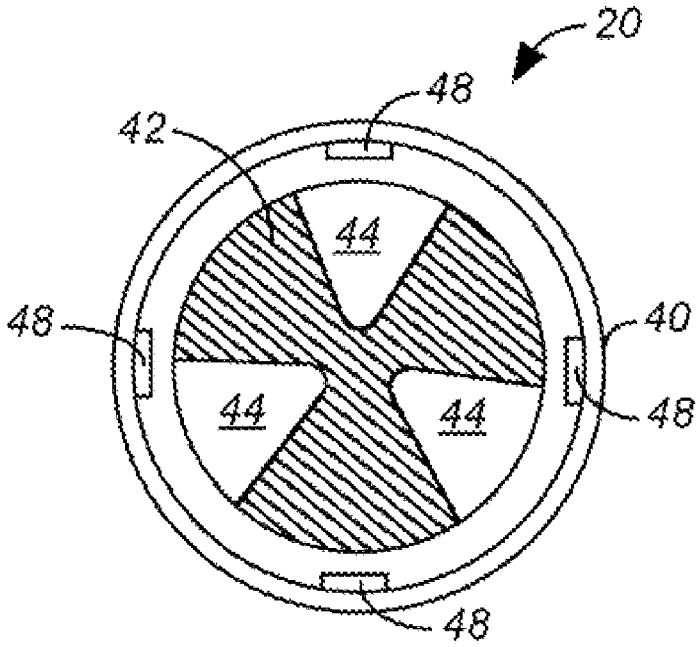
FIG. 4*a* is a top view of the cylindrical safety gate in accordance with one embodiment of the invention.
Figure 4B:
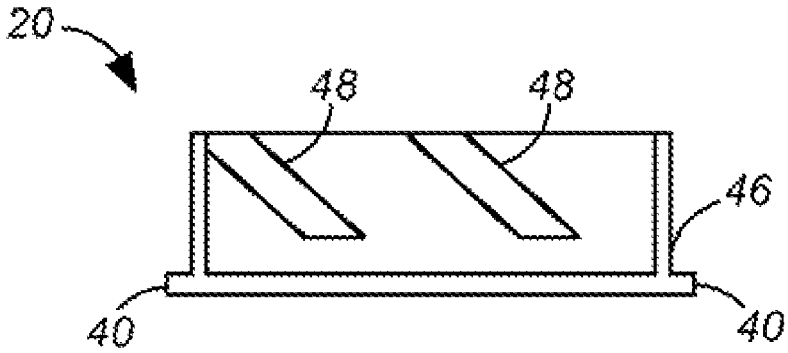
FIG. 4*b* is a cross sectional view of the cylindrical safety gate in accordance with one embodiment of the invention.

FIG. 4*a* is a top view of the cylindrical safety gate 20 in accordance with one embodiment of the invention. FIG. 4*b* is a cross sectional view of the cylindrical safety gate 20 in accordance with one embodiment of the invention. The safety gate 20 has a lip 40 at one end. The safety gate 20 has a gate 42, which is shaped like three wedges and a number of apertures 44. The exterior wall 46 has a number of grooves 48 formed therein. Only the exits of the grooves 48 can be seen in FIG. 4*a*. The grooves 48 are curved and in this embodiment the grooves are semicircular when projected onto a vertical plane.

Figure 5A:
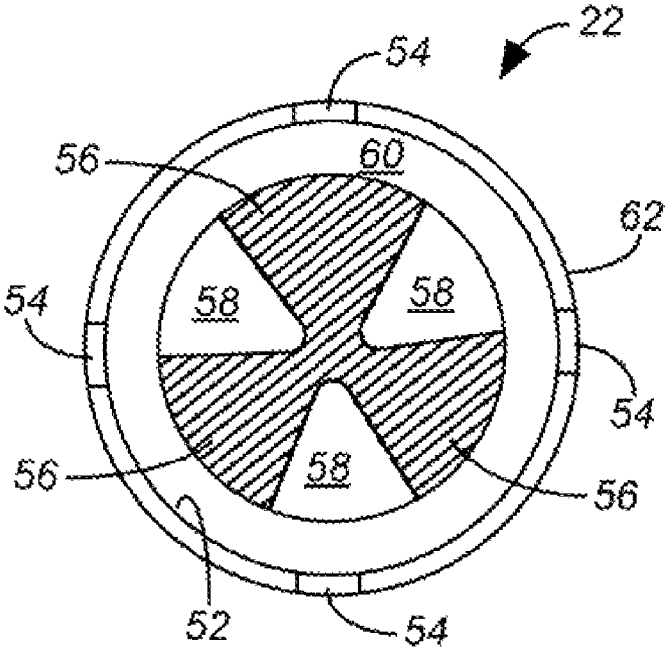
FIG. 5*a* is a bottom view of the bottle cap in accordance with one embodiment of the invention.
Figure 5B:
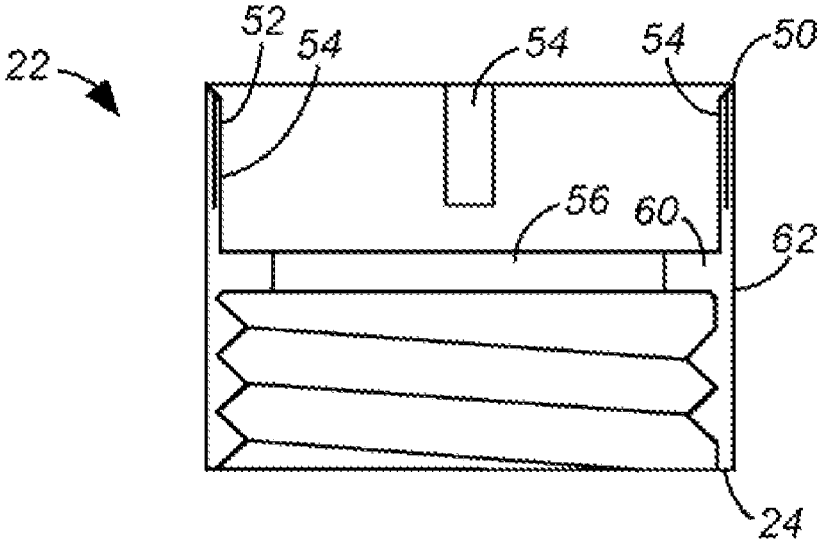
FIG. 5*b* is a cross sectional view of the bottle cap in accordance with one embodiment of the invention.

FIG. 5*a* is a bottom view of the bottle cap 22 in accordance with one embodiment of the invention. FIG. 5*b* is a cross sectional view of the bottle cap 22 in accordance with one embodiment of the invention. The bottle cap 22 has a threaded end 24 and a gate end 50. On an interior wall 52 is a plurality of grooves 54. The bottle cap 22 has a gate or gates 56 that are wedge shaped. The bottle cap 22 has a number of apertures 58. The gates 56 are attached to a ledge 60 that is connected to the cylindrical walls 62.

Figure 6:
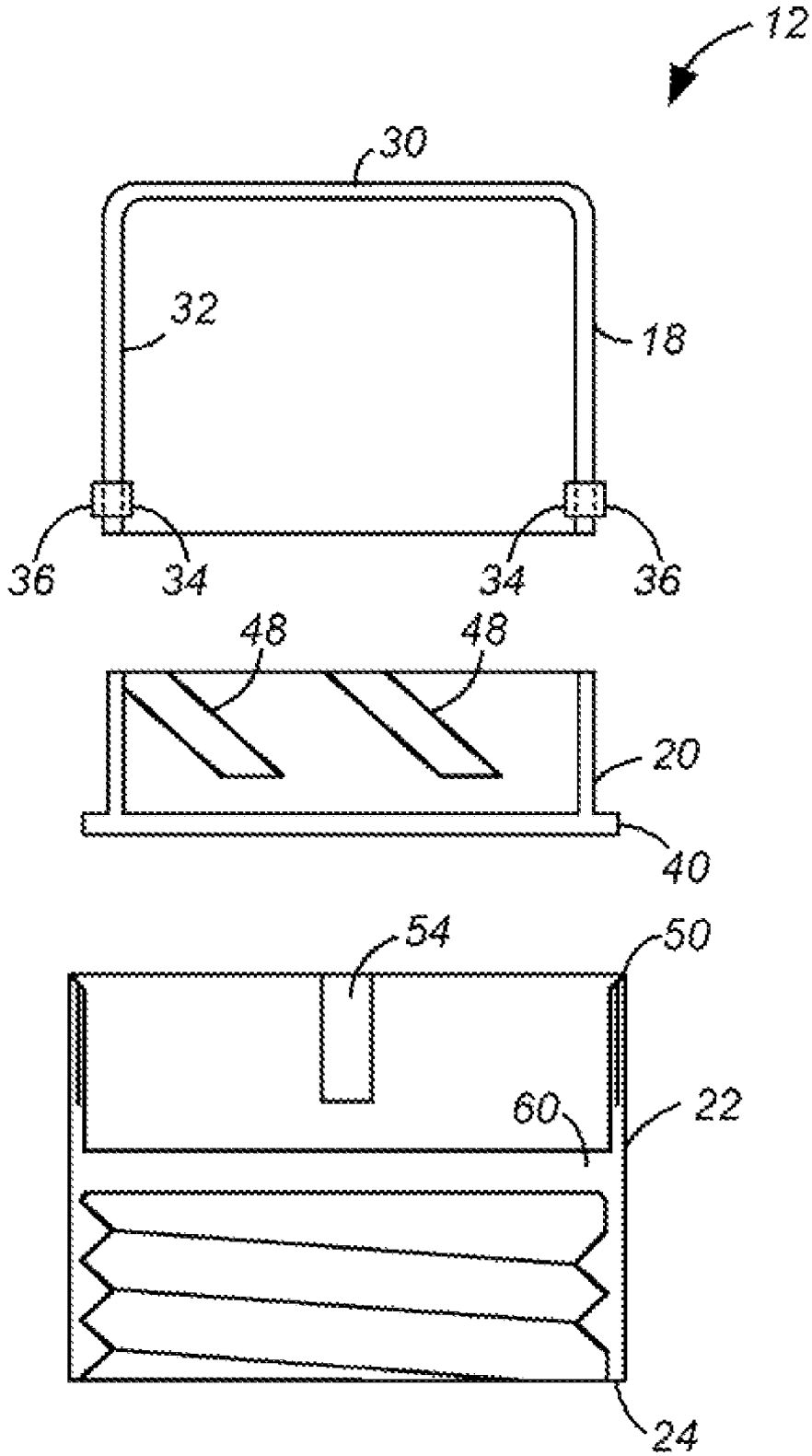
FIG. 6 is an exploded cross sectional view of the cap in accordance with one embodiment of the invention.

FIG. 6 is an exploded cross sectional view of the cap 12 in accordance with one embodiment of the invention. As can be seen in the combination of FIGS. 1 & 6 the inner protrusions 34 of the product cap 18 mate with the grooves 48 of the safety gate 20. The outer protrusions 36 of the product cap 30 mate with the grooves 54 of the bottle cap 22. The lip 40 of the safety gate 20 rests on the lip 60 of the bottle cap 22. Note that the groove 54 may not extend all the way to the edge of the gate end 50 of the bottle cap 22 and therefore capture the product cap 18. As the product cap 18 is pressed down the safety gate 20 is rotated as the inner protrusion 34 is pushed down through the slot 48. The product cap 18 does not rotate, since the outer protrusions 36 move along the straight slots 54. As a result, the gates 42 of the safety gate 20 rotate relative to the gates 56 of the bottle cap 22 and the apertures 44 of the safety gate 20 become aligned with the apertures 58 of the bottle cap 22 thereby releasing the flavor mix in the product reservoir.

Thus there has been described a cap for holding a powder to be mixed with a fluid in a bottle that does not have a membrane, does not require modification to existing water bottle designs and is inexpensive to manufacture.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A cap for holding a powder to be mixed with a fluid in a bottle, comprising:

a product cap having a reservoir, the product cap having a top wall and a side wall, the product cap having a plurality of inner protrusions on the side wall and a plurality of outer protrusions on the side wall;

a cylindrical safety gate having a plurality of grooves, the plurality of inner protrusions of the product cap mating with the plurality of grooves, the cylindrical safety gate having a gate and an aperture at an end of the cylindrical safety gate; and a bottle cap having a cylindrical body with a threaded end and a gate end, the gate end having a plurality of grooves that mate with the plurality of outer protrusions, the bottle cap having a gate and an aperture between the threaded end and the gate end, whereby pressing on the product cap causes the apertures to be aligned and the powder is released into the bottle.

2. The cap of claim 1, wherein the plurality of grooves of the cylindrical safety gate are curves.

3. The cap of claim 2, wherein the curve formed by one of the plurality of grooves is roughly semicircular when projected onto a plane.

4. The cap of claim 2, wherein the cylindrical safety gate has a lip at the end of the cylindrical safety gate.

5. The cap of claim 4, wherein the plurality of grooves of the bottle cap are straight.

6. The cap of claim 5, wherein the bottle cap has a ridge that engages the lip of the cylindrical safety gate.

7. The cap of claim 1, wherein the threaded end does not project into the bottle.

8. A cap for holding a powder to be mixed with a fluid in a bottle, comprising:

a product cap shaped like a cylindrical cup, having a top and a cylindrical wall, an inner peg extending from the cylindrical wall and an outer peg extending from the cylindrical wall;

a cylindrical safety gate having an exterior groove that mates with the inner peg of the product cap, wherein the groove is a curve, the cylindrical safety gate having a gate and an aperture at an end of the cylindrical safety gate; and a bottle cap having a threaded end and a gate end, the gate end having an inner groove that mates with the outer peg of the product cap, the bottle cap having a gate and an aperture between the threaded end and the gate end, whereby pressing on the product cap causes the apertures to be aligned and the powder is released into the bottle.

9. The cap of claim 8, wherein the cylindrical safety gate has at least two wedge shaped gates and at least two wedge shaped apertures.

10. The cap of claim 9, wherein the gate of the bottle cap has at least two wedge shaped gates and at least two wedge shaped apertures.

11. The cap of claim 10, the threaded end of the bottle cap screws onto a standard water bottle.

12. The cap of claim 11, wherein the bottle cap does not extend into the standard water bottle.

13. The cap of claim 12, wherein the cylindrical safety gate has a lip at the end of the cylindrical safety gate.

14. The cap of claim 13, wherein the plurality of grooves of the bottle cap are straight.

15. The cap of claim 14, wherein the bottle cap has a ridge that engages the lip of the cylindrical safety gate.

* * * * *